US005430246A

United States Patent [19]

Lace, Sr. et al.

[11] Patent Number: 5,430,246

[45] Date of Patent: Jul. 4, 1995

[54] DUAL COIL PICK-UP ASSEMBLY FOR A SPRINGED MUSICAL INSTRUMENT

[75] Inventors: Donald A. Lace, Sr.; Dorothy Lace, both of Huntington Beach, Calif.

[73] Assignee: Actodyne General, Inc., Huntington Beach, Calif.

[21] Appl. No.: 396

[22] Filed: Jan. 4, 1993

[51] Int. Cl.[6] ..... G10H 3/18

[52] U.S. Cl. ..... 84/726

[58] Field of Search ..... 84/725, 726

[56] References Cited

U.S. PATENT DOCUMENTS

| | | | |
|---|---|---|---|
| Re. 32,520 | 10/1987 | Lace . | |
| 2,089,171 | 8/1937 | Beauchamp . | |
| 2,119,584 | 7/1938 | Knoblaugh . | |
| 2,175,325 | 10/1939 | Sunshine . | |
| 2,209,016 | 7/1940 | Dickerson . | |
| 2,294,861 | 9/1942 | Fuller . | |
| 2,445,046 | 7/1948 | Tinkham . | |
| 2,557,754 | 6/1951 | Morrison . | |
| 2,567,570 | 9/1951 | McCarty . | |
| 2,573,254 | 10/1951 | Fender . | |
| 2,612,541 | 9/1952 | DeArmond . | |
| 2,683,388 | 7/1954 | Keller . | |
| 2,725,778 | 12/1955 | Cronwell . | |
| 2,764,052 | 9/1956 | McBride . | |
| 2,817,261 | 12/1957 | Fender . | |
| 2,892,371 | 6/1959 | Butts . | |
| 2,896,491 | 7/1959 | Lover . | |
| 2,909,092 | 10/1959 | DeArmond et al. . | |
| 2,911,871 | 11/1959 | Schultz . | |
| 2,968,204 | 1/1961 | Fender . | |
| 2,976,755 | 3/1961 | Fender . | |
| 3,066,567 | 12/1962 | Kelley, Jr. . | |
| 3,183,296 | 5/1965 | Miessner . | |
| 3,236,930 | 2/1966 | Fender . | |
| 3,249,677 | 5/1966 | Burns et al. . | |
| 3,290,424 | 12/1966 | Fender . | |
| 3,417,268 | 12/1968 | Lace . | |
| 3,483,303 | 12/1969 | Warner . | |
| 3,530,228 | 9/1970 | Scherer . | |
| 3,535,968 | 10/1970 | Rickard . | |
| 3,541,219 | 11/1970 | Abair . | |
| 3,571,483 | 3/1971 | Davidson . | |
| 3,588,311 | 6/1971 | Zoller . | |
| 3,602,627 | 8/1971 | McCammon . | |
| 3,657,461 | 4/1972 | Freeman . | |
| 3,668,295 | 6/1972 | Broussard . | |
| 3,711,619 | 1/1973 | Jones . | |
| 3,715,446 | 2/1973 | Kosinski . | |
| 3,725,561 | 4/1973 | Paul . | |
| 3,902,394 | 9/1975 | Stich . | |
| 3,911,777 | 10/1975 | Rendell . | |
| 3,916,751 | 11/1975 | Stich . | |
| 3,962,946 | 6/1976 | Rickard | 84/725 |
| 3,983,777 | 10/1976 | Bartolini . | |
| 3,983,778 | 10/1976 | Bartolini . | |
| 4,026,178 | 5/1977 | Fuller . | |
| 4,056,255 | 11/1977 | Lace . | |
| 4,133,243 | 1/1979 | DiMarzio . | |
| 4,268,771 | 5/1981 | Lace . | |
| 4,269,103 | 5/1981 | Underwood . | |
| 4,283,982 | 8/1981 | Armstrong | 84/725 |
| 4,320,681 | 3/1982 | Altilio . | |
| 4,372,186 | 2/1983 | Aaroe | 84/725 |
| 4,379,421 | 4/1983 | Nunan . | |
| 4,442,749 | 4/1984 | DiMarzio et al. . | |
| 4,624,172 | 11/1986 | McDougall . | |
| 4,809,578 | 3/1989 | Lace, Jr. | 84/725 |
| 4,878,412 | 11/1989 | Resnick . | |

FOREIGN PATENT DOCUMENTS

| | | |
|---|---|---|
| 0480432 | 4/1992 | European Pat. Off. . |
| 1047453 | 11/1966 | United Kingdom . |

*Primary Examiner*—William M. Shoop, Jr.
*Assistant Examiner*—Jeffrey W. Donels
*Attorney, Agent, or Firm*—Bliss McGlynn

[57] ABSTRACT

A dual coil pick-up assembly for a stringed musical instrument having a plurality of moveable strings includes a case having a longitudinal channel with first and second sections. The pick-up assembly also includes first and second magnet structures disposed in the first and second sections having opposite polarities and a coil structure disposed in the first and second sections of the channel for eliminating hum in the pick-up assembly due to stray magnetic fields.

19 Claims, 2 Drawing Sheets

DUAL COIL PICK-UP ASSEMBLY FOR A SPRINGED MUSICAL INSTRUMENT

BACKGROUND OF THE INVENTION

1. Field of the Invention

The present invention relates generally to musical instruments and, more particularly, to a dual coil pick-up assembly for use with stringed musical instruments.

2. Description of the Related Art

Generally, stringed musical instruments such as an electric guitar have electromagnetic sensors or pick-ups for sensing mechanical vibrations of the strings and converting such into electrical signals. The electrical signals from the electromagnetic sensors or pick-ups are amplified and modified and, ultimately, reconverted into acoustical energy to produce music and the like.

An example of such an electromagnetic sensor or pick-up is disclosed in U.S. Pat. No. 4,809,578, issued Mar. 7, 1989, entitled "Magnetic Field Shaping In An Acoustic Pick-up Assembly", the disclosure of which is hereby incorporated by reference. This patented pick-up assembly includes an elongated ferromagnetic case lined on the interior thereof with planar permanent magnet pieces to present the same magnetic polarity into the interior thereof. The patented pick-up assembly also includes cores disposed in the interior of the case and having a plurality of coplanar, spaced, finger-like projections directed at the walls of the case. The walls and projections are permanently magnetized to a common magnetic polarity which will concentrate by magnetic repulsion flux into gaps between the projections. A coil is wound around the cores and the flux changes of these concentrated flux fields due to string motion induce a voltage in the coil. The coil has terminals connected to a socket in the stringed musical instrument for connection to an amplifier and speaker system.

Although the above patented pick-up assembly has worked well, it is typically situated among a mass of electronic equipment. As a result, the pick-up assembly may respond to stray magnetic fields and attenuate extraneous noise or hum which is undesired.

Moreover, musicians which play stringed musical instruments are desirous of having pick-ups which incorporate greater sensitivity to the full range of acoustic energy generated by the movement of such strings. However, such greater sensitivity often requires a balancing of the overall sensitivity of the pick-up and the attenuation of extraneous noise or hum. Thus, there is a need in the art to provide a pick-up which has greater sensitivity and substantially eliminates extraneous noise or hum.

SUMMARY OF THE INVENTION

It is, therefore, one object of the present invention to provide a dual coil pick-up assembly for a stringed musical instrument.

It is another object of the present invention to provide a dual coil pick-up assembly which substantially eliminates extraneous noise or hum.

It is yet another object of the present invention to provide a dual coil pick-up assembly which has a greater sensitivity.

It is still another object of the present invention to provide a "humbucking" or hum canceling pick-up assembly.

It is a further object of the present invention to provide a humbucking dual coil pick-up assembly which is less expense to manufacture and assemble.

To achieve the foregoing objects, the present invention is a dual coil pick-up assembly for a stringed musical instrument having a plurality of moveable strings. The pick-up assembly includes a case having means forming a longitudinal channel with first and second sections. The pick-up assembly also includes first magnet means disposed in the first section for producing a first magnetic polarity and second magnet means disposed in the second section for producing a second magnetic polarity opposite to the first magnetic polarity. The pick-up assembly further includes dual coil means disposed in the first and second sections for eliminating hum in the pick-up assembly due to stray magnetic fields.

One advantage of the present invention is that a dual coil pick-up assembly is provided for a stringed musical instrument. Another advantage of the present invention is that the dual coil pick-up assembly provides greater sensitivity while substantially eliminating extraneous noise. Yet another advantage of the present invention is that a dual coil pick-up assembly is provided which produces a humbucking effect by an arrangement of two coils such that the hum in one of the coils cancels out that in the other, while the signals in each coil add together to produce a stronger signal. A further advantage of the present invention is that a humbucking dual coil pick-up assembly is provided which is less expensive to manufacture and assemble by placing two coils in an end-to-end longitudinal arrangement.

Other objects, features and advantages of the present invention will be readily appreciated as the same becomes better understood after reading the subsequent description taken in conjunction with the accompanying drawings.

DESCRIPTION OF THE PREFERRED EMBODIMENT(S)

Figure 1:
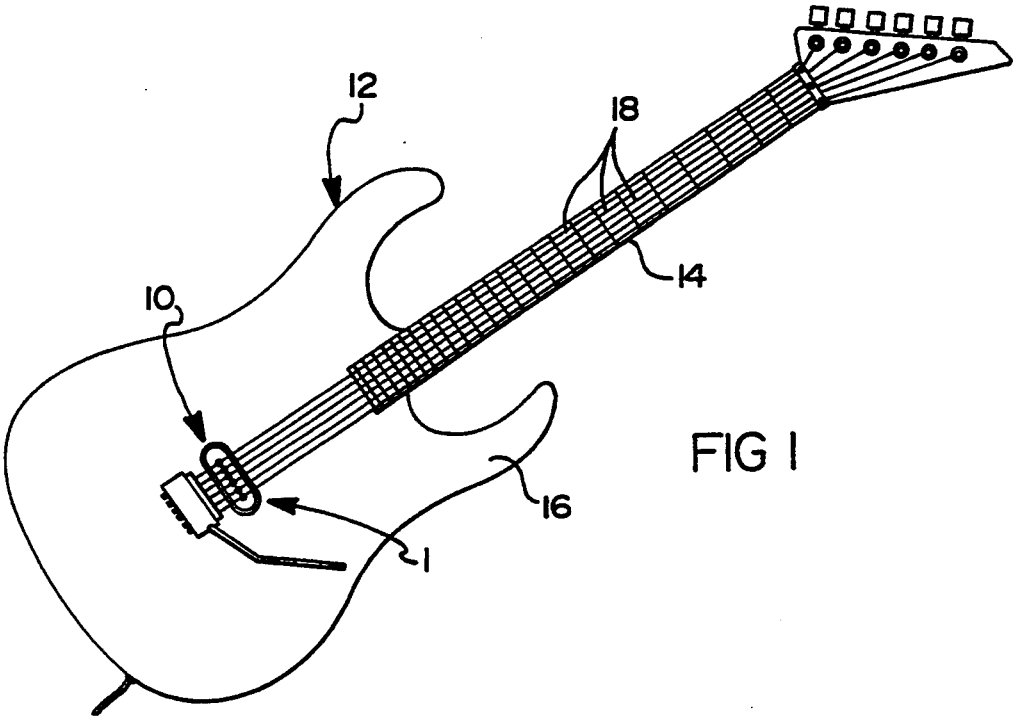
FIG. 1 is perspective view of a dual coil pick-up assembly, according to the present invention, illustrated in operational relationship to a stringed musical instrument.

Referring to the drawings and in particular to FIG. 1, a dual coil pick-up assembly 10, according to the present invention, is illustrated in operational relationship with a stringed musical instrument such as a guitar, generally indicated at 12. The guitar 12 is of the electric type and has a neck portion 14, a body portion 16, and a plurality of strings 18 extending along the neck and body portions 14 and 16. The pick-up assembly 10 is disposed beneath the strings 18 and mounted to the body portion 16 in a manner to be described.

Figure 2:
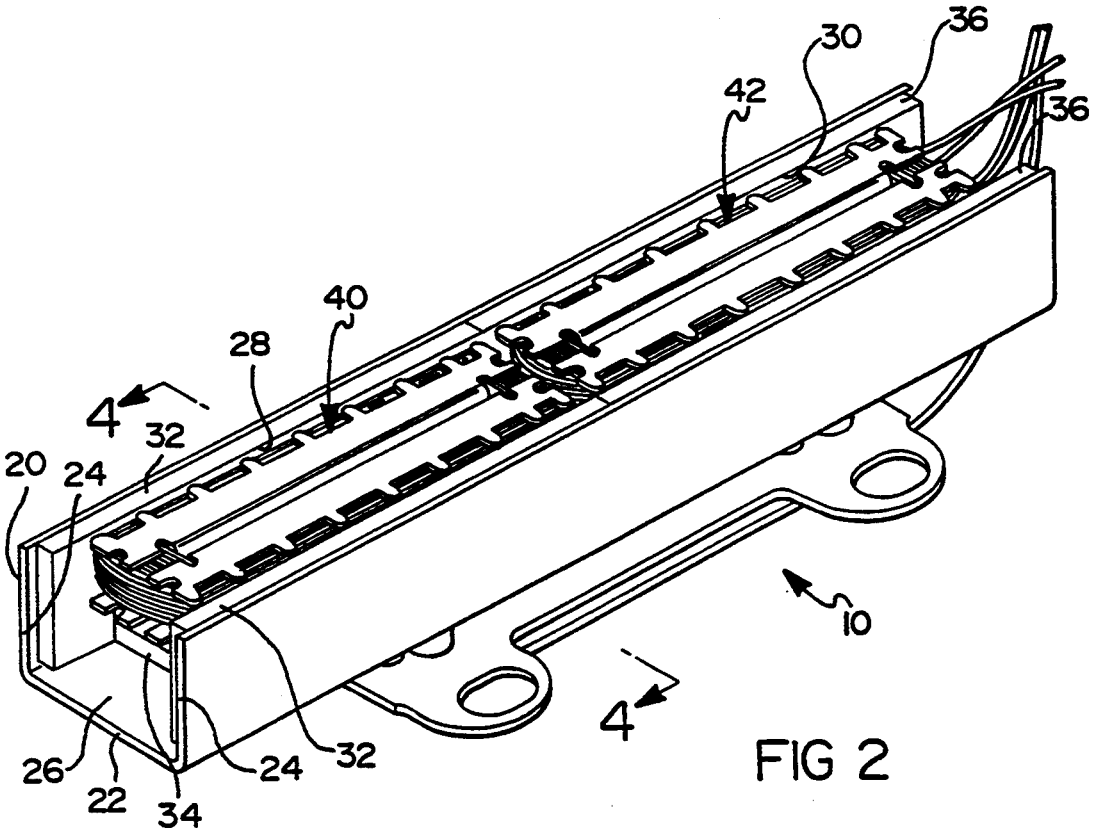
FIG. 2 is an enlarged perspective view of the dual coil pick-up assembly of FIG. 1.
Figure 3:
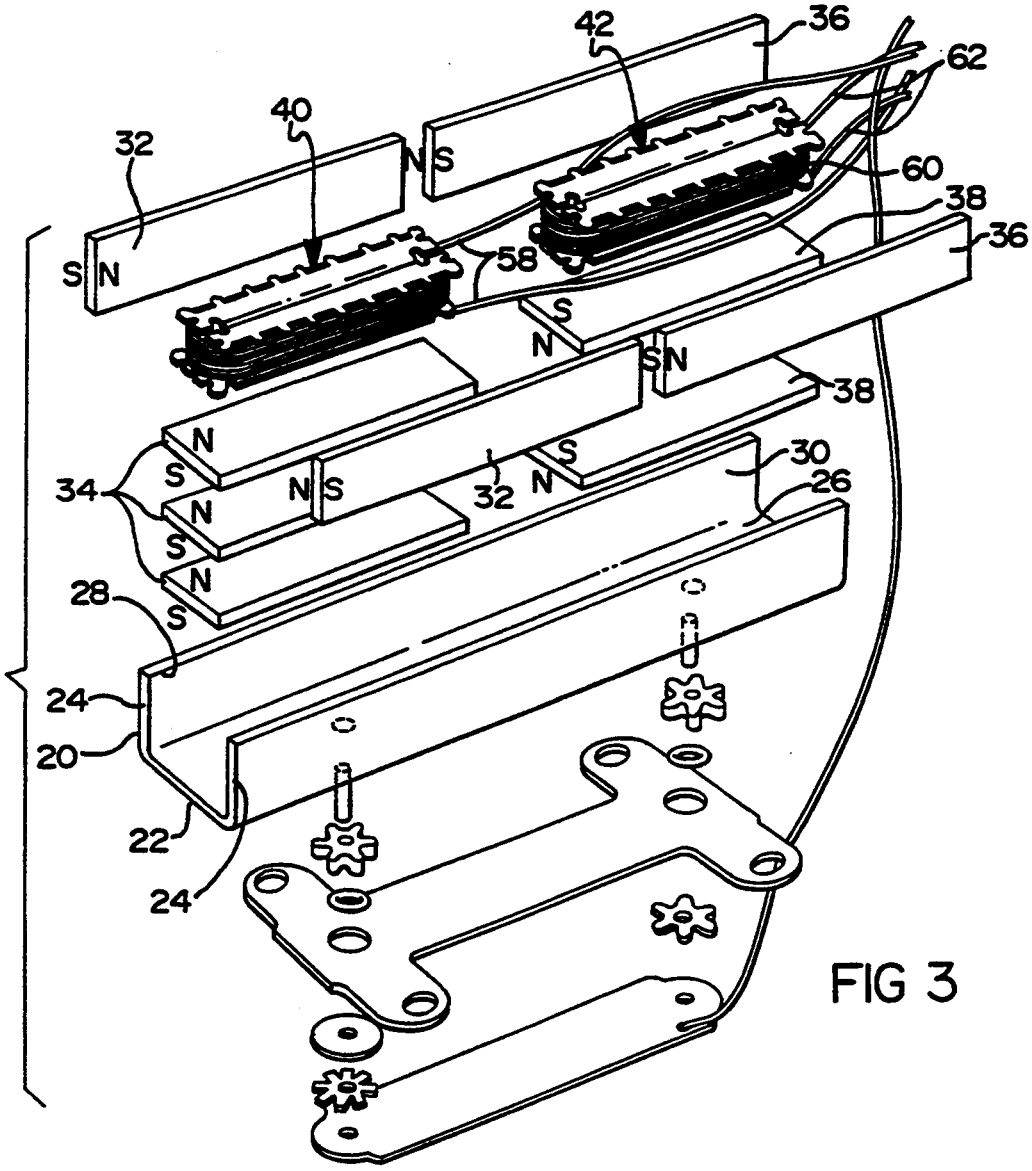
FIG. 3 is an exploded perspective view of the dual coil pick-up assembly of FIGS. 1 and 2.
Figure 4:
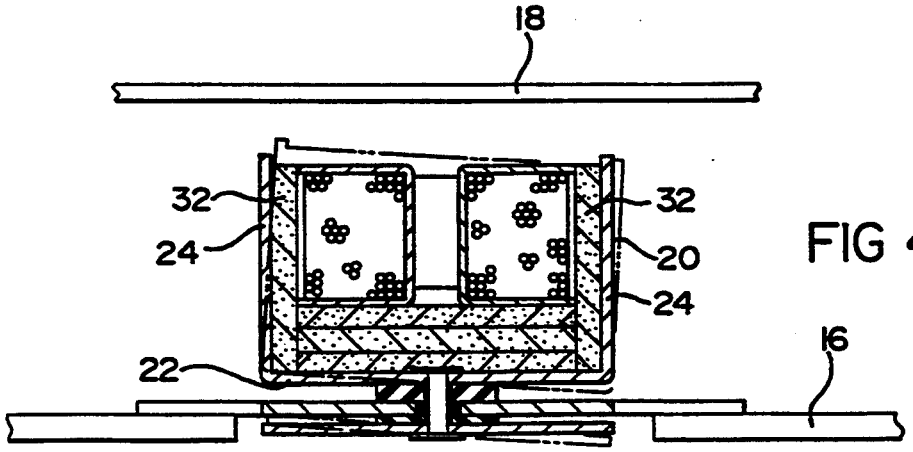
FIG. 4 is a sectional view taken along lines 4—4 of FIG. 2.

Referring to FIGS. 2 through 4, the dual coil pick-up assembly 10 includes a case 20 extending longitudinally and having a general "U" shape. The case 20 has a generally planar base wall 22 and a pair of generally planar side walls 24 substantially parallel to each other and perpendicular to the base wall 22 to form a longitudinal channel 26. The case 20 is made of a ferromagnetic material such as an iron based steel. The case 20 is divided into a first section 28 which has a first common magnetic polarity and a second section 30 which has a second common magnetic polarity opposite to that of the first section 28. It should be appreciated that the first section 28 and second section 30 are arranged in a longitudinal end-to-end relationship.

The first section 28 includes at least one generally planar permanent magnet strip 32 and 34 disposed in the channel 26 and mounted to interior surfaces of the side and base walls 24 and 22, respectively, of the case 20 by suitable means such as an adhesive bonding agent. The permanent magnet strips 32 and 34 extend longitudinally and are generally rectangular in shape. The permanent magnet strips 32 have a height less than a height of the side walls 24 to allow an insulating strip (not shown) to be disposed on the edges thereof and a non magnetic membrane (not shown) to be stretched across the edges of the side walls 24. Preferably, a plurality or three (3) permanent magnet strips 34 are disposed between the permanent magnet strips 32 and adhered to each other and to the interior surface of the base wall 22 to obtain a predetermined height.

The permanent magnet strips 32 and 34 are arranged to collectively present a first common magnetic polarity facing the interior of the first section 28 of the channel 26. The permanent magnet strips 32 and 34 are arranged in the first section 28 to present their north (N) magnetic polarity facing toward the interior of the channel 26 and their south (S) magnetic polarity impressed on the case 20.

The second section 30 also includes at least one generally planar permanent magnet strip 36 and 38 disposed in the channel 26 and mounted to interior surfaces of the side and base walls 24 and 22, respectively, of the case 20 by suitable means such as an adhesive bonding agent. The permanent magnet strips 36 and 38 extend longitudinally and are generally rectangular in shape. The permanent magnet strips 36 and 38 are similar to the permanent magnet strips 32 and 34 and a plurality or three (3) permanent magnet strips 38 are adhered to each other and to the interior surface of the base wall 22. The permanent magnet strips 36 and 38 are arranged to collectively present a second common magnetic polarity facing the interior of the second section 30 of the channel 26. Preferably, the permanent magnet strips 36 and 38 are arranged in the second section 30 to present their south (S) magnetic polarity facing toward the interior of the channel 26 and their north (N) magnetic polarity impressed on the case 20.

The dual coil pick-up assembly 10 also includes a first coil assembly, generally indicated at 40, disposed in the first section 28 and a second coil assembly, generally indicated at 42, disposed in the second section 30. The first and second coil assemblies 40 and 42 include a pair of core or frame pieces 44 and 46 having a general "C" shape. The core pieces 44 and 46 are made of a ferromagnetic material such as an iron based steel. The core pieces 44 and 46 are orientated in a back to back relationship. The first and second coil assemblies 40 and 42 also include at least one insulating spacer 48 disposed between the core pieces 44 and 46 to form a gap 50 therebetween such that the core pieces 44 and 46 do not directly contact each other. The core pieces 44 and 46 have a plurality of recesses 52 at exposed exterior edges thereof to define rows of tooth-like projections or teeth 54 for a function to be described.

The first coil assembly 40 further includes a conductive wire such as copper wrapped or wound around the core pieces 44 and 46 in a first direction to form a first pick-up coil 56. The first pick-up coil 56 has a pair of first leads 58 extending outwardly from one end of the channel 26. The second coil assembly 42 also includes a conductive wire such as copper wrapped or wound around the core pieces 44 and 46 in a second direction opposite to the first direction to form a second pick-up coil 60. The second pick-up coil 60 has a pair of second leads 62 extending outwardly from one end of the channel 26. The first and second leads 58 and 62 are connected together in series and to a socket (not shown) on the guitar 12 for connection to an amplifier and speaker system (not shown).

In operation, the first coil assembly 40 is disposed in the first section 28 of the channel 26 and mounted to the upper permanent magnet strip 34 by suitable means such as an adhesive bonding agent. The core pieces 44 and 46 of the first coil assembly 40 are magnetically polarized to the N polarity of the adjacent faces of the permanent magnet strips 32 and 34. Likewise, the second coil assembly 42 is disposed in the second section 30 of the channel 26 and spaced from the first coil assembly 40. The second coil assembly 42 is mounted on the upper permanent magnet strip 38 by suitable means such as an adhesive bonding agent. The core pieces 44 and 46 of the second coil assembly 42 are magnetically polarized to the S polarity of the adjacent faces of the strips 36 and 38. The recesses 52 between the adjacent teeth 54, together with the adjacent permanent magnet strips 32, 34 and 36, 38 thus define magnetic flux bottles or geometric flux shaping forms in each recess 52. Each recess 52, therefore, proximate its center forms effectively a vector source FS from which flux lines FL, in a radial fan out, extend to the nearest oppositely polarized side wall 24 as illustrated in FIG. 4.

When a string 18 moves the magnetic field, the flux pattern will change, thus inducing a voltage in the first pick-up coil 56 and second pick-up coil 60. Since the first and second pick-up coils 56 and 60 are wound in opposite directions around their respective core pieces 44 and 46 and connected together in series, the net signal from the dual coil pick-up assembly 10 is the sum of the signals in the first and second pick-up coils 56 and 60 and the hum in one of the coils 56, 60 cancels out that in the other.

Accordingly, the dual coil pick-up assembly 10 has an arrangement of two coils 56, 60 such that the hum in one of the coils cancels out that in the other, while the signals in each coil add together to produce a stronger signal. Also, the coils 56, 60 are arranged in a longitudinal end-to-end relationship, resulting in smaller coils assembled in one longitudinally extending case 20, making it less expensive to manufacture and assemble.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A dual coil pick-up assembly for a stringed musical instrument having a plurality of moveable strings comprising:

a case including means forming a longitudinal channel having first and second sections arranged longitudinally end to end;

first magnet means disposed in said first section for producing a first magnetic polarity;

second magnet means disposed in said second section for producing a second magnetic polarity opposite to said first magnetic polarity; and a first coil assembly disposed in said first section and a second coil assembly disposed in said second section for eliminating hum in said pick-up assembly due to stray magnetic fields.

2. A dual coil pick-up assembly as set forth in claim 1 wherein said first magnet means comprises at least one first magnet strip mounted to an interior of said channel forming means.

3. A dual coil pick-up assembly as set forth in claim 2 wherein said at least one first magnet strip has a south (S) polarity impressed on said case and a north (N) polarity facing said channel.

4. A dual coil pick-up assembly as set forth in claim 1 wherein said second magnet means comprises at least one second magnet strip mounted to an interior of said channel forming means.

5. A dual coil pick-up assembly as set forth in claim 4 wherein said at least one second magnet strip has a north (N) polarity impressed on said case and a south (S) polarity facing said channel.

6. A dual coil pick-up assembly as set forth in claim 1 wherein said first magnet means comprises at least one first magnet strip mounted to an interior of said channel forming means and said second magnet means comprises at least one second magnet strip mounted to an interior of said channel forming means.

7. A dual coil pick-up assembly as set forth in claim 6 wherein said at least one first magnet strip has a south (S) polarity impressed on said case and a north (N) polarity facing said channel and said at least one second magnet strip has a north (N) polarity impressed on said case and a south (S) polarity facing said channel.

8. A dual coil pick-up assembly as set forth in claim 1 wherein said first coil assembly is wound in a first direction and a second coil assembly is wound in a second direction opposite to said first direction.

9. A dual coil pick-up assembly as set forth in claim 1 wherein said first coil assembly and said second coil assembly are connected together in a series connection.

10. A dual coil pick-up assembly as set forth in claim 1 wherein said first coil assembly and said second coil assembly each comprise a pair of longitudinally extending core pieces have a plurality of spaced projections along one edge thereof.

11. A dual coil pick-up assembly as set forth in claim 10 wherein said core pieces are C-shaped and a spacer disposed therebetween in a back to back relationship.

12. A dual coil pick-up assembly as set forth in claim 11 wherein said first coil assembly further comprises a first coil wrapped in a first direction around said core pieces.

13. A dual coil pick-up assembly as set forth in claim 12 wherein said second coil assembly further comprises a second coil wrapped in a second direction around said core pieces opposite to said first direction.

14. A dual coil pick-up assembly as set forth in claim 13 wherein said first and second coils are connected together in a series connection.

15. A dual coil pick-up assembly for a stringed musical instrument having a plurality of moveable strings comprising:

a case having walls forming a longitudinal channel having first and second sections arranged longitudinally end to end;

at least one first magnet disposed in said first section for producing a first magnetic polarity;

at least one second magnet disposed in said second section for producing a second magnetic polarity opposite to said first magnetic polarity; and a first coil assembly disposed in said first section and a second coil assembly disposed in said second section for eliminating hum in said pick-up assembly due to stray magnetic fields.

16. A dual coil pick-up assembly as set forth in claim 15 wherein said at least one first magnet comprises first magnet strips mounted to interior surfaces of said walls and said at least one second magnet comprises second magnet strips mounted to interior surfaces of said walls.

17. A dual coil pick-up assembly as set forth in claim 16 wherein said first magnet strips have a south (S) polarity impressed on said case and a north (N) polarity facing said channel and said second magnet strips have a north (N) polarity impressed on said case and a south (S) polarity facing said channel.

18. A dual coil pick-up assembly as set forth in claim 17 wherein said first coil assembly is wound in a first direction and a second coil assembly is wound in a second direction opposite to said first direction and said first coil assembly and said second coil assembly are connected together in a series connection.

19. A dual coil pick-up assembly for a stringed musical instrument having a plurality of moveable strings comprising:

a case having a base wall and side walls forming a U-shaped longitudinal channel having first and second sections arranged longitudinally end to end;

first permanent magnet strips disposed in said first section and mounted to said base and side walls for producing a first magnetic polarity;

second permanent magnet strips disposed in said second section and mounted to said base and side walls for producing a second magnetic polarity opposite to said first magnetic polarity;

a first coil assembly disposed in said first section and a second coil assembly disposed in said second section;

said first coil assembly and said second coil assembly each comprising a pair of longitudinally extending core pieces have a plurality of spaced projections along one edge thereof, said core pieces being C-shaped and a spacer disposed therebetween in a back to back relationship;

said first coil assembly further comprising a coil wrapped in a first direction around said core pieces and said second coil assembly further comprising a coil wrapped in a second direction around said core pieces opposite to said first direction; and said first and second coil being connected together in a series connection.

* * * * *

UNITED STATES PATENT AND TRADEMARK OFFICE

CERTIFICATE OF CORRECTION

PATENT NO. : 5,430,246

DATED : July 4, 1995

INVENTOR(S) : Donald A. Lace, Sr.

It is certified that error appears in the above-indentified patent and that said Letters Patent is hereby corrected as shown below:

Title page and col. 1, line 3, "SPRINGED" should be —STRINGED—

In the Title

Signed and Sealed this

Tenth Day of October, 1995

*Attest:*

Bruce Lehman

BRUCE LEHMAN

*Attesting Officer*

*Commissioner of Patents and Trademarks*